United States Patent [19]

Nakamura et al.

[11] Patent Number: 4,775,031

[45] Date of Patent: Oct. 4, 1988

[54] HYDRAULIC ELEVATOR AND CONTROL METHOD THEREOF

[75] Inventors: Ichirō Nakamura, Katsuta; Satoshi Kobayashi, Chiyoda; Toshihiko Nara, Katsuta, all of Japan

[73] Assignee: Hitachi, Ltd., Tokyo, Japan

[21] Appl. No.: 63,300

[22] Filed: Jun. 18, 1987

[30] Foreign Application Priority Data

Jun. 20, 1986 [JP] Japan ..... 61-143029

[51] Int. Cl.[4] ..... B66B 1/04

[52] U.S. Cl. ..... 187/111

[58] Field of Search ..... 187/110, 111, 116, 117

[56] References Cited

U.S. PATENT DOCUMENTS

| | | | |
|---|---|---|---|
| 3,187,844 | 6/1965 | MacNair et al. | 187/111 |
| 3,977,497 | 8/1976 | McMurray | 187/111 |
| 4,161,235 | 7/1979 | Caputo et al. | 187/116 |
| 4,311,212 | 1/1982 | Simpson | 187/111 |
| 4,485,895 | 12/1984 | Tachino et al. | 187/116 |
| 4,499,974 | 2/1985 | Nguyen et al. | 187/117 |
| 4,534,452 | 8/1985 | Ogasawara et al. | 187/110 |

*Primary Examiner*—William M. Shoop, Jr.
*Assistant Examiner*—W. E. Duncanson, Jr.
*Attorney, Agent, or Firm*—Antonelli, Terry & Wands

[57] ABSTRACT

A hydraulic elevator, wherein actual speed characteristics are detected so that they can be used together with desired speed characteristics in such a manner that the speed control accuracy of the car itself is improved.

13 Claims, 3 Drawing Sheets

HYDRAULIC ELEVATOR AND CONTROL METHOD THEREOF

FIELD OF THE INVENTION

The present invention relates to a hydraulic elevator and a control method thereof, and more particularly to a hydraulic elevator and a control method thereof which is capable of directly or indirectly lifting and lowering a car by controlling a flow of pressurized fluid supplied to or delivered from a hydraulic jack.

BACKGROUND OF THE INVENTION

The speed characteristics of the car of this type of conventional hydraulic elevator tend to change in principle when there is a variation in the load applied to the car and/or the temperature of the fluid and this causes a change in the flow controlled by means of the flow control valve or the flow intake by or flow discharge from a hydraulic pump. As a result, the terminal slowdown time is elongated, and this elongation deteriorates riding comfort, increases the energy loss and elongates the operation time, etc.

In order to overcome the above problems, an operating method for a hydraulic elevator has been proposed in, for example, U.S. Pat. No. 4,534,452 in which the actual start of the deceleration function is delayed to take place after the time at which a deceleration stopping/starting command is made when the terminal slowdown time is long. This operating method is carried out on the basis of an estimation of the actual speed of the car without the employment of any detector.

Namely, as described above, the flow of the pressurized fluid controlled through the flow control valve varies in accordance with the load applied to the car and changes in the fluid temperature. Such a variation is effected in accordance with a certain law.

A deceleration starting delay time is, therefore, calculated so as to obtain a desired terminal slowdown time by estimating the full speed, the terminal slowdown speed and the time required to bring down the speed from the full speed to the terminal slowdown speed. These factors are estimated in accordance with factors such as the load, the fluid pressure, and the fluid temperature of the hydraulic elevator which is operated.

However, in this conventional operating method the required factors to obtain the deceleration starting delay time are estimated by detecting the operating state of the hydraulic elevator. The accuracy and the convergence of the speed characteristics compensation, therefore, necessarily depend upon the estimated accuracy without exception.

As a result, it is difficult to estimate the value accurately because of the imprecise manufacture and the imprecise adjustment of the flow control valve. Accordingly, it is impossible to carry out a control for the hydraulic elevator with greater accuracy because of the deteriorations of the precisions during control and the convergence.

SUMMARY OF THE INVENTION

An object of the present invention is to provide a hydraulic elevator and a control method thereof capable of overcoming the above stated problems, wherein the precisions in control and the convergence are improved by adjusting the speed characteristics.

The above object of the present invention can be attained by controlling the car speed, wherein the control is carried out by utilizing the speed characteristics of an actual car obtained by means of a car position and car speed detector and the desired speed characteristics.

A hydraulic elevator in which a flow supplied to and delivered from a hydraulic jack is controlled so as to lift and lower a car, and a deceleration is carried out at a predetermined deceleration starting point in such a manner that said car is driven at a low terminal slowdown speed when said car reaches at a terminal.

A car deceleration control means for hydraulic elevator of the present invention comprises a means for detecting at least one of a position and a speed of the car, a means for obtaining a deceleration stopping distance from the start of to the end of the deceleration in accordance with the speed characteristics of the car being obtained based on a value detected by the detecting means, and a means for controlling the deceleration in accordance with a difference between the obtained or actual deceleration stopping distance and a desired value of a predetermined deceleration stopping distance, thereby controlling the deceleration of the car through an output from the deceleration controlling means.

According to the hydraulic elevator and the control method thereof of the present invention, as described above, the controlling accuracy and the convergence as they relate to the compensation are greatly improved by obtaining the speed characteristics of the actual car by the car speed and car position detecting device such that these speed characteristics and the desired speed characteristics are used to calculate the deceleration stopping distance after compensation. The decelerating stopping distance is used to process a deceleration command which acts to effect the speed control of the car of the hydraulic elevator.

DESCRIPTION OF THE INVENTION

Figure 1:
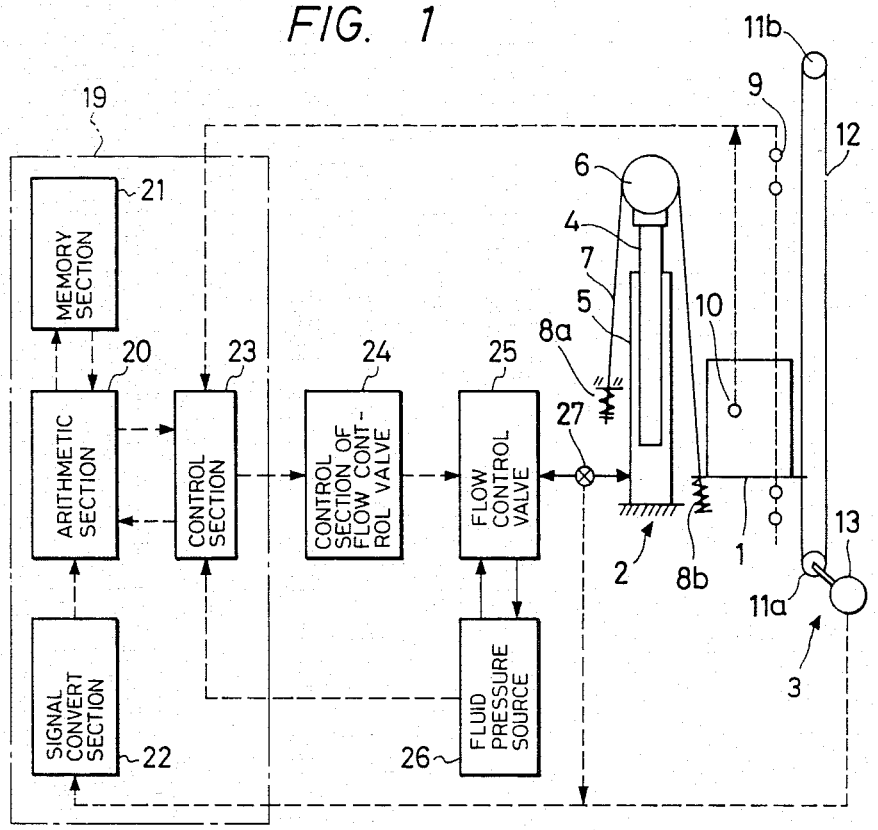
FIG. 1 is a view showing a control system for a hydraulic elevator according to one embodiment of the present invention.

FIG. 1 shows the hydraulic elevator according to one embodiment of the present invention. The main structural elements of the hydraulic elevator of one embodiment of the present invention constructed are a controlling apparatus 19 consisting of an arithmetic and processing section 20, a memory section 21, a signal converting section 22, and a control section 23; a control section 24 for controlling a flow control valve 25 which amplifies the signal from the controlling apparatus 19; a fluid pressure source 26, a flow control valve 25, a hydraulic jack 2, a car 1, and a car speed and car position detecting device 3.

The accompanying figure shows a hydraulic elevator of the type in which the car 1 is driven indirectly by means of a hydraulic jack 2 which comprises a cylinder 5 and a plunger 4 through a pulley 6 which is provided at the top of the plunger 4 and a rope 7. However, a hydraulic elevator of the type, in which the car 1 is provided at the top of the hydraulic jack 2 so as to allow the car 1 to be directly driven, can obtain a similar effect.

Furthermore, although FIG. 1 shows the type in which the car speed is controlled by the flow control valve 25, a similar effect can be, of course, obtained with a type wherein the discharge amount of the hydraulic pump means is controlled, or the type wherein the rotational speed of the motor is controlled. According to the latter type of speed control, the control section 24 for controlling the flow control valve 25 would serve as a pump discharge amount controlling portion or a motor rotational speed controlling portion.

The structure of the hydraulic elevator according to the present invention will now be described.

The arithmetic and processing section 20 processes and feeds the information to the control section 23 wherein the information acting to drive car 1 is processed according to an algorithm previously prepared based on a command and a signal from the control section 23, a signal from the signal convert section 22 and the information stored in the memory section 21.

The control section 23 receives various commands and signals from the terminal floor, the car 1 and the outer tower or a frame, and feeds the necessary information to the arithmetic and processing section 20. The control section 23 carries out an operation and a pause of the fluid pressure source 26 and further controls the flow control valve 25 through the section 24 for controlling the flow control valve 25 based on the information from the arithmetic and processing section 20.

The section 24 for controlling the flow control valve 25 amplifies the signal which was fed in and actually operates the flow control valve 25. The flow control valve 25 supplies the pressurized fluid fed from the fluid pressure source 26 in accordance with a signal from the section 24 for controlling the flow control valve 25 to the hydraulic jack 2, or delivers the pressurized fluid fed from the hydraulic jack 2 to a tank of the fluid pressure source 26.

A detector 27 is adapted to detect the operating condition. In accordance with necessity, the detector 27 detects the load, the fluid temperature and so on which are the factors for governing operating condition of the hydraulic elevator. The hydraulic jack 2 lifts the car 1 through the pulley 6 and the rope 7, when receiving the supply of the high pressurized fluid, and lowers the car 1 when the high pressurized fluid is delivered due to its dead weight. Spring members 8*a* and 8*b* are used so as to absorb impact which occurs on starting or stopping of the car 1.

The car speed and car position detecting device 3 comprises a rope or a tape 12 which is arranged between the pulley members 11*a* and 11*b*, which are provided in the outer tower or a frame and fixed to the car 1, and a rotary encoder 13 which is connected to the pulley member 11*a*. The speed and position detecting device 3 detects the speed or the position of the car 1 as a train of pulse signals.

Although the above mentioned structure is illustrated, another type of structure such as one in which a roller is secured to the rotary encoder 13 and the relative motion between the car 1 and the guide rail is detected may be employed, so long as the operation of the car 1 is capable of being detected.

The operation of the hydraulic elevator according to present invention will now be described.

The controlling apparatus 19 detects by means of the detector 27 either the load applied to the car 1 or the fluid temperature or both, they are the factors governing the operating condition of the car 1, and feeds either or both to the arithmetic and processing section 20 through the signal convert section 22.

The arithmetic and processing section 20 receives commands such as driving direction and destination and so on from the control section 23 and calculates the controlling signal, which is most suitable for the current operating condition using the information stored in the memory section 21 and the information from the signal convert section 22, and then feeds the result of this to the control section 23. The algorithm for processing the control signal will be described later.

The control section 23 processes a train of pulse signals which is adapted to actually drive the flow control valve 25 and feeds it to the control section 24 for controlling the flow control valve 25, igniting the fluid pressure source 26, if necessary. The plunger 4 lifts or lowers the car 1 through the pulley 6 and the rope 7 using the pressurized fluid which is, as mentioned above, supplied to or delivered from the hydraulic jack 2 when the control section 24 for controlling the flow control valve 25 amplifies the signal so as to drive the flow control valve 25.

The movement of the car 1 in this state is detected by the car speed and position detector 3 and is obtained by the signal convert section 22 to make the arithmetic and processing section 20 process each responding information when the car 1 reaches the decelerating position or stopping position so as to control the flow control valve 25 through the control section 23 and the control section 24 for controlling the flow control valve 25 for the purpose of decelerating or stopping the car 1.

Figure 2:
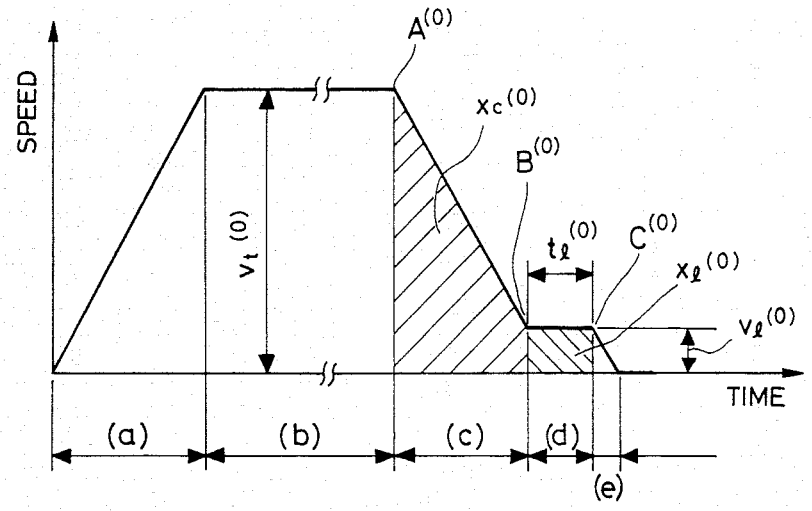
FIG. 2 is a view showing a desired speed characteristics.

The speed characteristics of the car 1 is controlled as shown in FIG. 2, wherein (a) represents the acceleration, (b) represents the running at a rated speed, (c) represents the deceleration, (d) represents the terminal slowdown running, and (e) represents the pause. The desired speed characteristics are stored in the memory section 21. The speed characteristics comprises the accelerating time, the decelerating time, the maximum speed, the terminal slowdown speed, the terminal slowdown time, the deceleration starting position, and the deceleration stopping position and so on.

The algorithm for control will now be described. The desired speed characteristics, as shown in FIG. 2, comprises the deceleration starting point, the deceleration finishing point and the stopping point which are represented by $A^{(0)}$, $B^{(0)}$ and $C^{(0)}$, respectively. And the desired distance $A^{(0)} \rightarrow B^{(0)}$ is shown by $x_c^{(0)}$, the desired distance $B^{(0)} \rightarrow C^{(0)}$ is shown by $x_l$, and the desired time is shown by $t_l^{(0)}$.

The arithmetic and processing section 20 processes the speed signal for the deceleration, and the flow control valve 25 is controlled by this speed signal so as to control the car speed, as shown in the figure, when the car 1 reaches the point near the stopping point $x_d^{(0)} = x_c^{(0)} + x_l^{(0)}$.

Figure 3:
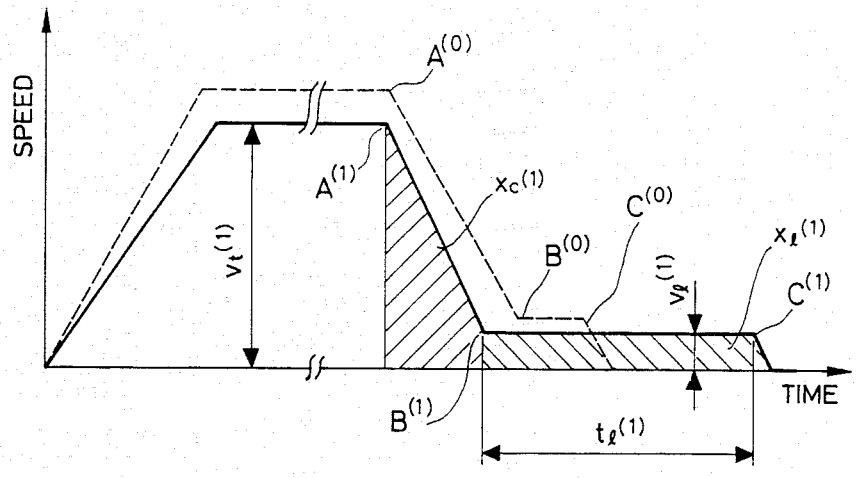
FIG. 3 is a view showing an actual speed characteristics.

However, the speed characteristics for the car 1 is not always as shown in FIG. 2, sometimes when the operating condition is changed, it is as shown in the FIG. 3, wherein the acceleration is carried out slowly and the deceleration is carried out speedily, and the full speed $v_t$ and the terminal slowdown speed $v_l$ becoming slow.

Therefore, the car running distance $x_c^{(1)}$ between the deceleration start $A^{(1)} \rightarrow$ the deceleration finish $B^{(1)}$ becomes shorter than $x_c^{(0)}$. The terminal slowdown distance $x_l^{(1)}$, therefore, becomes longer than $x_l^{(0)}$, and the terminal slowdown time $t_l^{(1)}$ becomes longer than $t_l^{(0)}$. That is, the operating time of the hydraulic elevator becomes longer, and this causes deterioration of comfort for those riding in the car 1, increases the energy consumption and also raises the fluid temperature.

According to the present invention, the speed characteristics of the car 1 which was detected by the rotary encoder 13 of the car speed and position detector 3 was used to obtain $v_l^{(1)}$ and $x_c^{(1)}$ so as to calculate the deceleration stopping distance after compensating $x_d^{(1)} = x_c^{(1)} + v_l^{(1)} \cdot t_l^{(0)}$. Simultaneously, $x_d^{(1)}$ is stored in the memory section 21 together with the load and the fluid temperature which are factors of the operating condition of the car 1.

Figure 4:
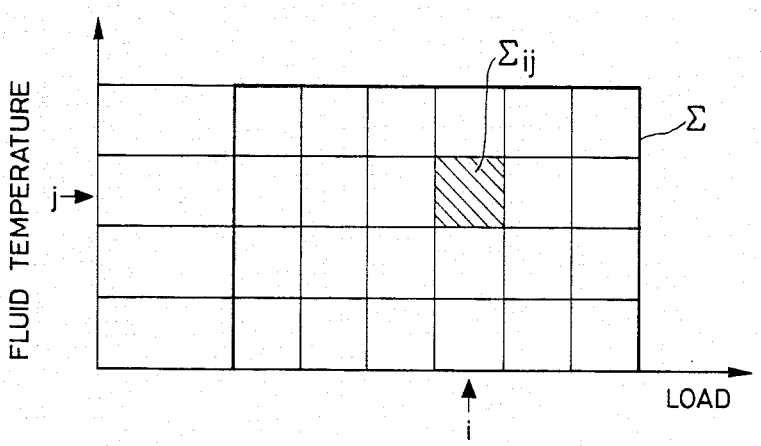
FIG. 4 is an explanatory view showing the region partitioning the operating condition which is to be memorized.
Figure 5:
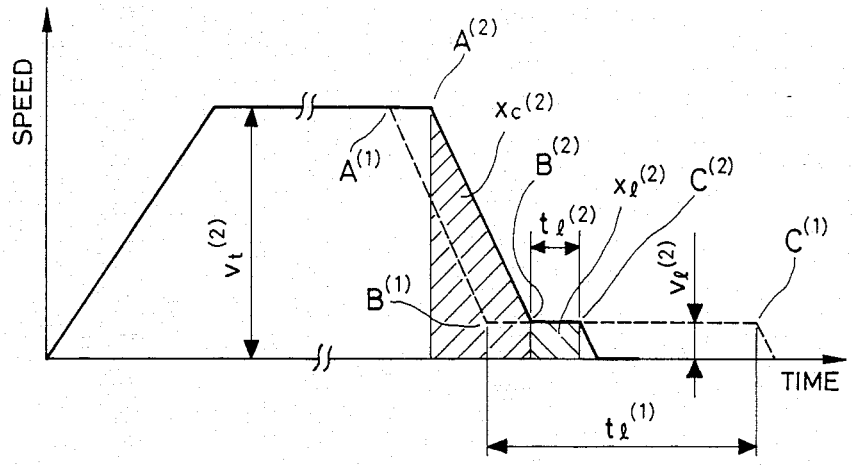
FIG. 5 is an explanatory view showing the improvement in the speed characteristics obtained by the compensation effected in accordance with the present invention.

The storing method is arranged to divide a usage region $\Sigma$ of the load and the fluid temperature, as shown in FIG. 4, into a plurality of small regions $\Sigma_{ij}$ so as to be stored in the corresponding small regions. And then, $x_d^{(1)}$, which is stored in this $\Sigma_{ij}$, is used so as to start the deceleration when the car 1 reaches the position $x_d^{(1)}$ near the stopping position, when the hydraulic elevator is operated under operating conditions which are in accordance with this $\Sigma_{ij}$. The relationship is shown in FIG. 5.

As a result, the car 1 starts decelerating after running at full speed over the delayed distance for the deceleration which is longer than that at the first running by the following amount $$\begin{aligned} \Delta x &= (x_c^{(0)} + x_l^{(0)}) - (x_c^{(1)} + v_l^{(1)} \cdot t_l^{(0)}) \\ &= (x_c^{(1)} + x_l^{(1)}) - (x_c^{(1)} + v_l^{(1)} \cdot t_l^{(0)}). \end{aligned}$$

As a result, $A^{(2)} \rightarrow B^{(2)} \rightarrow C^{(2)}$ is obtained, and the terminal slowdown time is shortened excessively from $t_l^{(1)} \rightarrow t_l^{(2)}$, and $t_l^{(2)} \rightarrow t_l^{(0)}$ is obtained which is substantially equal to the desired time.

It is, therefore, possible to convert the terminal slowdown time $t_l^{(0)}$ to the desired terminal slowdown value $t_l^{(0)}$ in all the operating regions of the hydraulic elevator when the above mentioned method according to the present invention is carried out over all of the small regions.

Although the above equation is calculated with the desired terminal slowdown time $t_l^{(0)}$, it may, of course, employ the desired terminal slowdown distance $x_l^{(0)}$ to calculate $x_d^{(1)} = x_c^{(1)} + x_l^{(0)}$, $$\begin{aligned} \Delta x &= (x_c^{(0)} + x_l^{(0)}) - (x_c^{(1)} + x_l^{(0)}) \\ &= (x_c^{(1)} + x_l^{(1)}) - (x_c^{(1)} + x_l^{(0)}). \end{aligned}$$

The running characteristics of the hydraulic elevator can be made to become close to the desired characteristics by carrying out this control method whenever the elevator runs. If the compensation result is not sufficient after a single compensation, a plurality of compensations are repeated so as to be consistent with the desired running characteristics.

Figure 6:
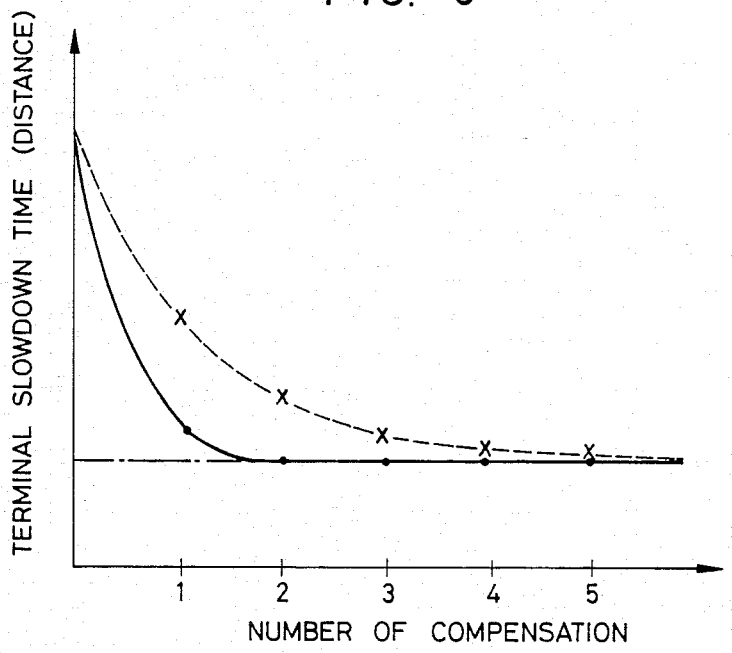
FIG. 6 is an explanatory view showing a comparison between the compensation effected in accordance with the present invention and the conventional form of compensation.

The compensation of the terminal slowdown time according to the control method of the present invention, as described above, (illustrated with a continuous line) is improved over the conventional control method (illustrated with a dashed line) in the final compensation accuracy and its convergence time is also decreased remarkably, as shown in FIG. 6.

The alternate long and short dash line shows the desired value. Needless to say, the terminal slowdown time $t_l$ becomes the desired terminal slowdown value $t_l^{(0)}$, and the operating time of the hydraulic elevator becomes always the shortest time.

Therefore, not only is comfort for those riding improved, but the energy consumption is also minimal and the amount of heat generated is reduced. As a result, the rise in the temperature of the fluid can be reduced to the minimum.

We claim:

1. A hydraulic elevator in which flow of fluid supplied to and delivered from a hydraulic jack is controlled so as to lift and lower a car, and wherein deceleration control is effected commencing at a predetermined deceleration starting point in such a manner that said car is driven to a low terminal slowdown speed when said car reaches a terminal, comprising:

means for detecting at least one of a position and speed of said car;

means for obtaining a deceleration stopping distance from the start to the stop of the deceleration in accordance with speed characteristics of said car corresponding to a value detected by said detecting means; and means, having an output, for controlling the deceleration in accordance with a difference between said obtained deceleration stopping distance and a corresponding desired value of a predetermined deceleration stopping distance, wherein the deceleration of said car is controlled through said output from said deceleration controlling means.

2. A hydraulic elevator according to claim 1, wherein said car deceleration control starts the deceleration after running a deceleration delayed distance which delays the start of the deceleration after a deceleration starting point.

3. A hydraulic elevator in which a car is lifted and lowered by controlling flow of fluid being supplied to and delivered from a hydraulic jack and in which deceleration and deceleration control starts from a predetermined deceleration starting point to a terminal slowdown speed when a terminal slowdown running is carried out, said deceleration control comprising:

means for detecting at least one of a position and a speed of said car;

means for obtaining running characteristics for running at said terminal slowdown speed in response to a value detected by said detecting means;

means for storing data corresponding to a deceleration delayed distance which delays the start of the deceleration from a deceleration starting point;

means for modifying said data in accordance with a difference between said running characteristic and a desired value of predetermined running characteristics;

means for replacing said data being stored in said memory means with a data which is modified by said modifying means; and means, having an output, for generating a deceleration start command, after said car has run from said deceleration starting point over said deceleration delayed distance which is given by said data, wherein the deceleration of said car is controlled through said output from said deceleration starting command generating means.

4. A hydraulic elevator according to claim 3, wherein said data stored in said memory means includes a plurality of data items which are in accordance with at least either a load applied to a hydraulic device including said hydraulic jack or an oil temperature.

5. A hydraulic elevator according to claim 3, wherein said data is a deceleration stopping distance from the start to the stop of the deceleration used for obtaining said deceleration delayed distance.

6. A hydraulic elevator according to claim 3, wherein said running characteristics includes a deceleration stopping distance from the start to the stop of the deceleration.

7. A hydraulic elevator according to claim 3, wherein said running characteristics includes a time taken from the start to stop of the deceleration.

8. A hydraulic elevator according to claim 3, wherein said running characteristics includes a terminal slowdown time which is a time during which said car runs at said terminal slowdown speed.

9. A hydraulic elevator in which a car is lifted and lowered by controlling flow of fluid supplied to and delivered from a hydraulic jack and having deceleration control for said car comprising:

means for detecting the position and speed of said car;

means for storing a desired value of the speed characteristics of said car; and controlling means, having an output, for generating a speed control command in accordance with a difference between said speed characteristics obtained from a value detected by said detecting means and said desired speed characteristic, wherein a flow supplied to and delivered from said hydraulic jack is controlled through said output from said controlling means.

10. A method of controlling a hydraulic elevator in which flow of fluid supplied to and delivered from a hydraulic jack is controlled for lifting and lowering a car including deceleration control, comprising the steps of:

detecting at least one of a position and speed of said car;

obtaining a deceleration stopping distance from the start to the stop of deceleration based on speed characteristics of said car; and controlling the deceleration of said car based on the dirfference between said stopping distance obtained and a corresponding desired value of a predetermined deceleration stopping distance.

11. In a hydraulic elevator wherein fluid flow supplied to and delivered from a hydraulic jack is controlled, via a flow control valve, for lifting and lowering a car, deceleration control is effected when deceleration commences at a predetermined deceleration starting point so as to enhance the start/stop quality control of said car by effecting a low slowdown speed when said car reaches a terminal, said deceleration control comrpises:

means for detecting the speed and location of said car;

means for detecting the operating condition characteristics of said hydraulic elevator and a controlling circuit including:

memory means for storing desired speed characteristics of said car, arithmetic processing means for receiving commands corresponding to direction of movement and destination of said car from a control means for determining therein a current condition control signal in accordance with the operating condition characteristics stored in said memory means and the actual speed location of said car in response to said detecting means, and wherein said control signal is fed to said control means which in turn generates a pulse train adapted for driving said control valve, whereby information obtained by said arithmetic means corresponding to each speed and location position of said car together with the corresponding operating condition characteristics detected each time said car reaches a decelerating position or stopping position results in correspondingly controlling said flow control valve for decelerating or stopping said car.

12. A hydraulic elevator according to claim 11, wherein said controlling circuit further includes:

a control section, coupling said control means to said flow control valve for effecting control of said hydraulic jack.

13. A hydraulic elevator according to claim 11, wherein said speed characteristics of said car comprise: accelerating time, decelerating time, maximum speed, terminal slowdown speed, terminal slowdown time, deceleration starting position, and deceleration stopping position.

* * * * *